US008689372B2

(12) United States Patent
Heimbrock

(10) Patent No.: US 8,689,372 B2
(45) Date of Patent: Apr. 8, 2014

(54) SIDERAIL HANDLE

(75) Inventor: Richard H. Heimbrock, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 13/194,278

(22) Filed: Jul. 29, 2011

(65) Prior Publication Data

US 2012/0023665 A1 Feb. 2, 2012

Related U.S. Application Data

(60) Provisional application No. 61/369,213, filed on Jul. 30, 2010.

(51) Int. Cl.
*A47C 21/08* (2006.01)

(52) U.S. Cl.
USPC ..... 5/425; 5/430; 5/424; 5/662

(58) Field of Classification Search
USPC ..... 5/425, 430, 429, 424, 100, 662, 428
See application file for complete search history.

(56) References Cited

U.S. PATENT DOCUMENTS

| | | | | |
|---|---|---|---|---|
| 2003/0051291 | A1 * | 3/2003 | Brooke et al. | 5/430 |
| 2008/0201844 | A1 * | 8/2008 | Gemeline et al. | 5/425 |
| 2009/0229049 | A1 * | 9/2009 | Heimbrock et al. | 5/425 |
| 2011/0185507 | A1 * | 8/2011 | Abernathey et al. | 5/662 |

* cited by examiner

*Primary Examiner* — Peter M Cuomo
*Assistant Examiner* — Brittany Wilson
(74) *Attorney, Agent, or Firm* — Jason Penninger

(57) ABSTRACT

A perimeter panel for a person-support apparatus comprises a panel body and a handle. The panel body includes a perimeter edge. The handle is movably coupled to the panel body and configured to move between a storage position and a deployed position. The handle forms a portion of the perimeter edge of the panel body when the handle is in the storage position and extends from the panel body in the deployed position.

20 Claims, 4 Drawing Sheets

SIDERAIL HANDLE

This Application claims priority to U.S. Provisional Application Ser. No. 61/369,213 titled SIDERAIL HANDLE filed on Jul. 30, 2010, the contents of which are incorporated herein by reference.

BACKGROUND OF THE DISCLOSURE

This disclosure relates generally to person-support apparatuses. More particularly, but not exclusively, one illustrative embodiment relates to a handle incorporated in a siderail assembly coupled to the person-support apparatus.

People occasionally need assistance during ingress/egress to/from a person-support apparatus. Ingress/egress assist devices, such as, grab bars and/or handles, can be used to assist a person attempting to ingress/egress to/from the person-support apparatus. While various person-support apparatuses have been developed, there is still room for development. Thus a need persists for further contributions in this area of technology.

SUMMARY OF THE DISCLOSURE

One illustrative embodiment of the present disclosure can include a siderail assembly with a siderail body having a handle movably coupled to the siderail body and configured to move between a first position where the handle can define a portion of the perimeter edge of the siderail body, and a second position where the handle can be oriented to assist with ingress/egress. Another illustrative embodiment can include a siderail assembly with a siderail body having a handle positioned within the siderail body in a storage position and extending from the siderail body in a deployed position to assist with ingress/egress from a person-support apparatus.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
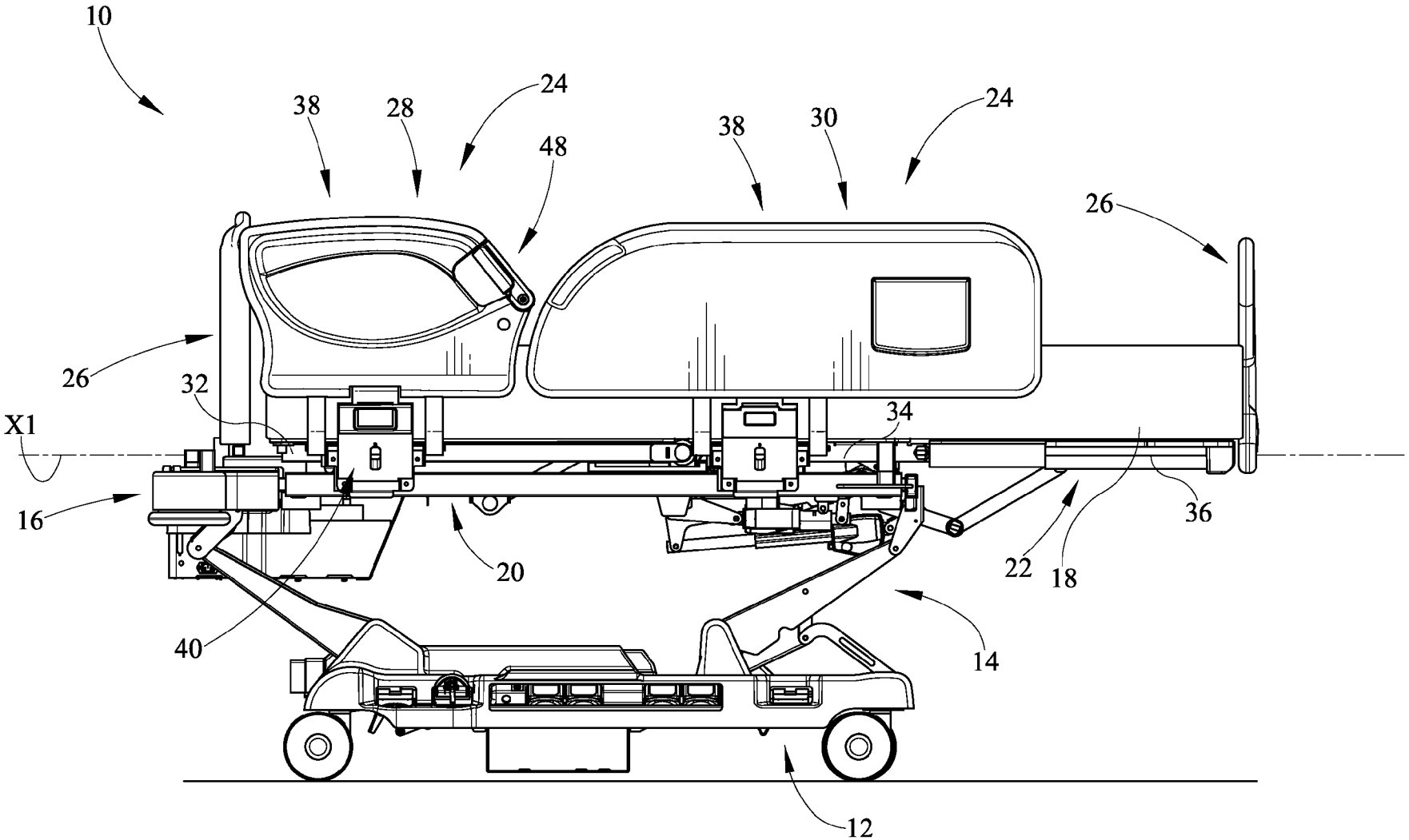
FIG. 1 is a side view of a person-support apparatus with the upper frame in a horizontal position and a siderail coupled thereto according to one illustrative embodiment of the disclosure.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

One illustrative embodiment of the present disclosure can include a siderail assembly with a siderail body having a handle movably coupled to the siderail body and configured to move between a first position where the handle can define a portion of the perimeter edge of the siderail body, and a second position where the handle can be oriented to assist with ingress/egress. Another illustrative embodiment can include a siderail assembly with a siderail body having a handle positioned within the siderail body in a storage position and extending from the siderail body in a deployed position to assist with ingress/egress from a person-support apparatus.

A person-support apparatus 10 according to one illustrative embodiment of the current disclosure is shown in FIGS. 1-4. The person-support apparatus 10 can be a hospital bed with a first section F1 or head support section F1, where the head of a person (not shown) can be positioned and a second section S1 or a foot support section S1, where the feet of the person (not shown) can be positioned. In some contemplated embodiments the person-support apparatus 10 can also be a hospital stretcher or an operating table. The person-support apparatus 10 can define a first longitudinal axis X1 passing through the first section F1 and the second section S1 and a transverse axis Y1 substantially perpendicular to the first longitudinal axis. In some contemplated embodiments the first longitudinal axis X1 and the transverse axis Y1 can be in the same horizontal plane. The person-support apparatus 10 can include a lower frame 12 or base 12, a plurality of supports 14 coupled with the lower frame 12 and an upper frame 16 movably supported by the plurality of supports 14 above the lower frame 12. In some contemplated embodiments the supports 14 can be lift mechanisms 14 that can move the upper frame 16 with respect to the lower frame 12. It should also be appreciated that in one illustrative embodiment, the person-support apparatus 10 can support a person-support surface 18 on the upper frame 16.

Figure 2:
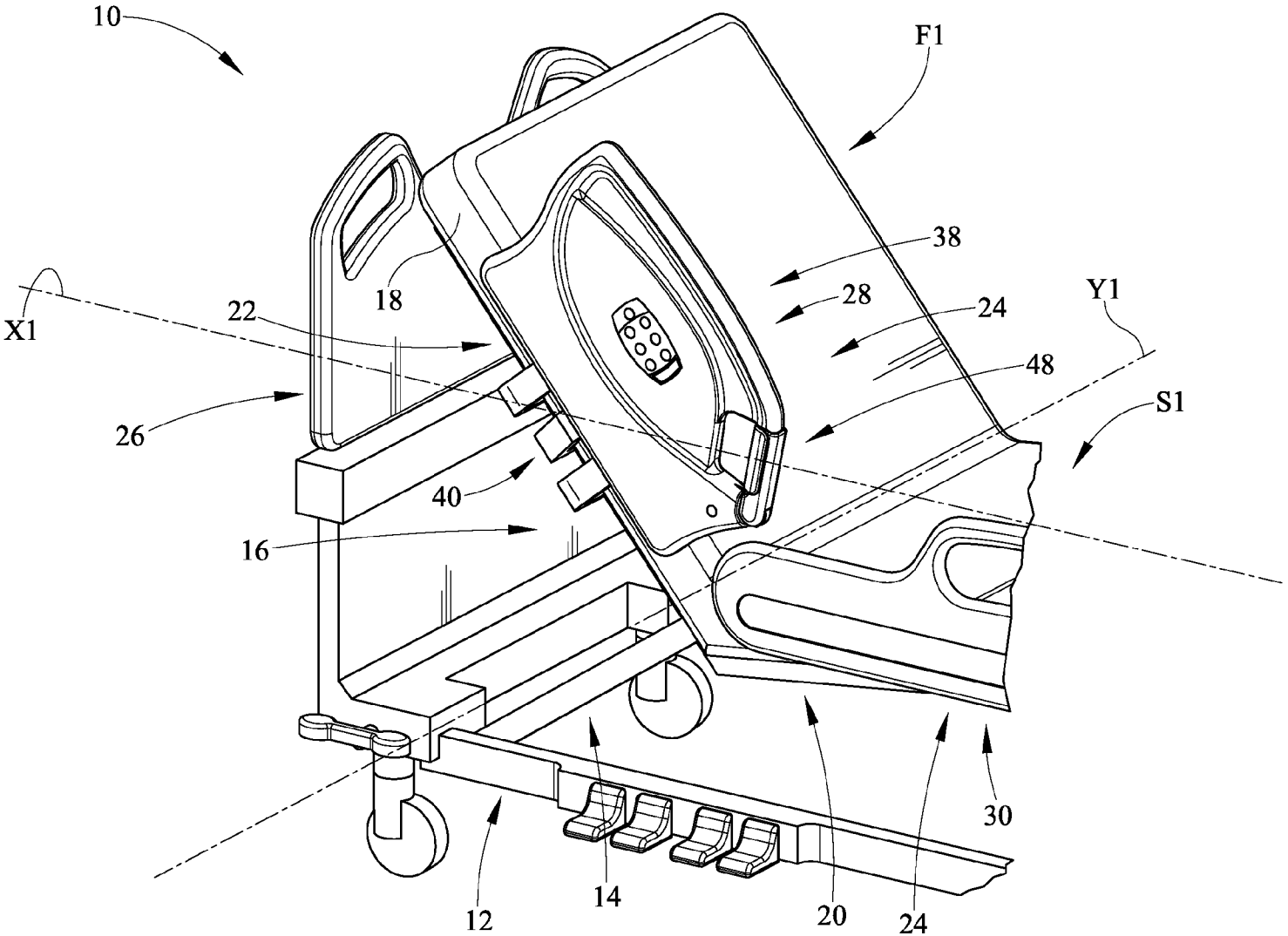
FIG. 2 is a perspective view of the person-support apparatus of FIG. 1 showing the siderail and the head section of the deck in a raised position with respect to the upper frame.

The upper frame 16 can include an upper frame base 20, a deck 22, siderails 24, and endboards 26 as shown in FIGS. 1 and 2. The siderails 24 and endboards 26 can be used to locate the perimeter edge of the upper frame 16. The plurality of siderails 24 can include a head siderail 28 and an intermediate siderail 30. The upper frame base 22 can be coupled to the supports 14 and can support the deck 22 thereon. The deck 22 can be configured to support a person supported on the person-support apparatus 10 in multiple articulated positions. The deck 22 can include a head portion 32, a seat portion 34, and a foot portion 36 that can be movably coupled to the upper frame base 20 and/or one another and can be configured to move with respect to the upper frame base 20 and/or one another. In one illustrative embodiment, the head siderail 28 can be coupled to the head portion 32 of the deck 22 and the intermediate siderail 30 can be coupled to the seat portion 34 of the deck.

The head siderail 28 can include a siderail body 38 and a movement assembly 40 as shown in FIGS. 1 and 2. The siderail movement assembly 40 can be configured to movably couple the siderail body 38 to the upper frame 16 and can move the siderail body 38 between a deployed position and a storage position. In some contemplated embodiments the movement assembly 40 can include a locking mechanism (not shown) that can be configured to maintain the siderail body 38 in the deployed position and/or the storage positions.

Figure 3:
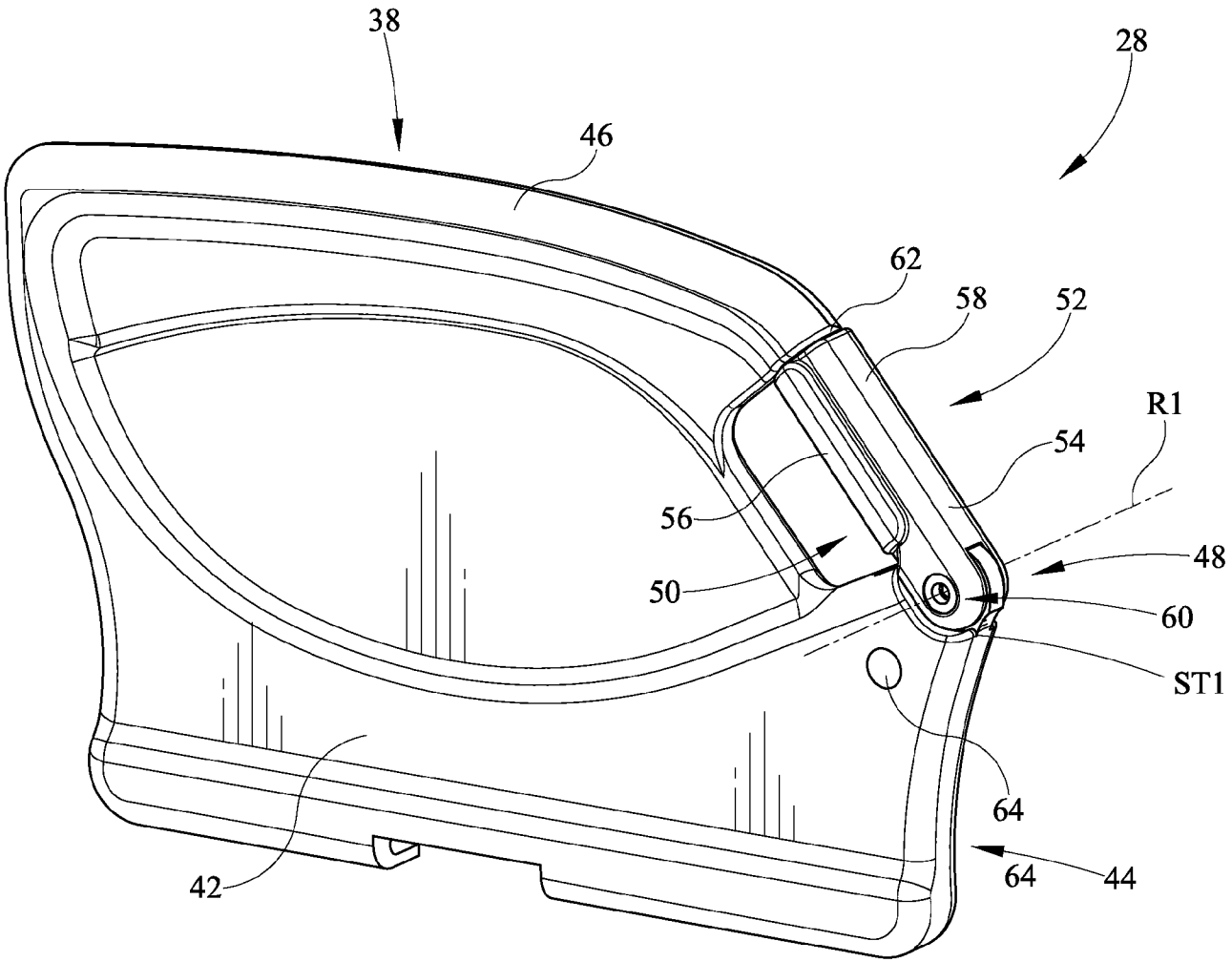
FIG. 3 is a perspective side view of the siderail of FIG. 1 showing the handle in a first position with respect to the siderail body.
Figure 4:
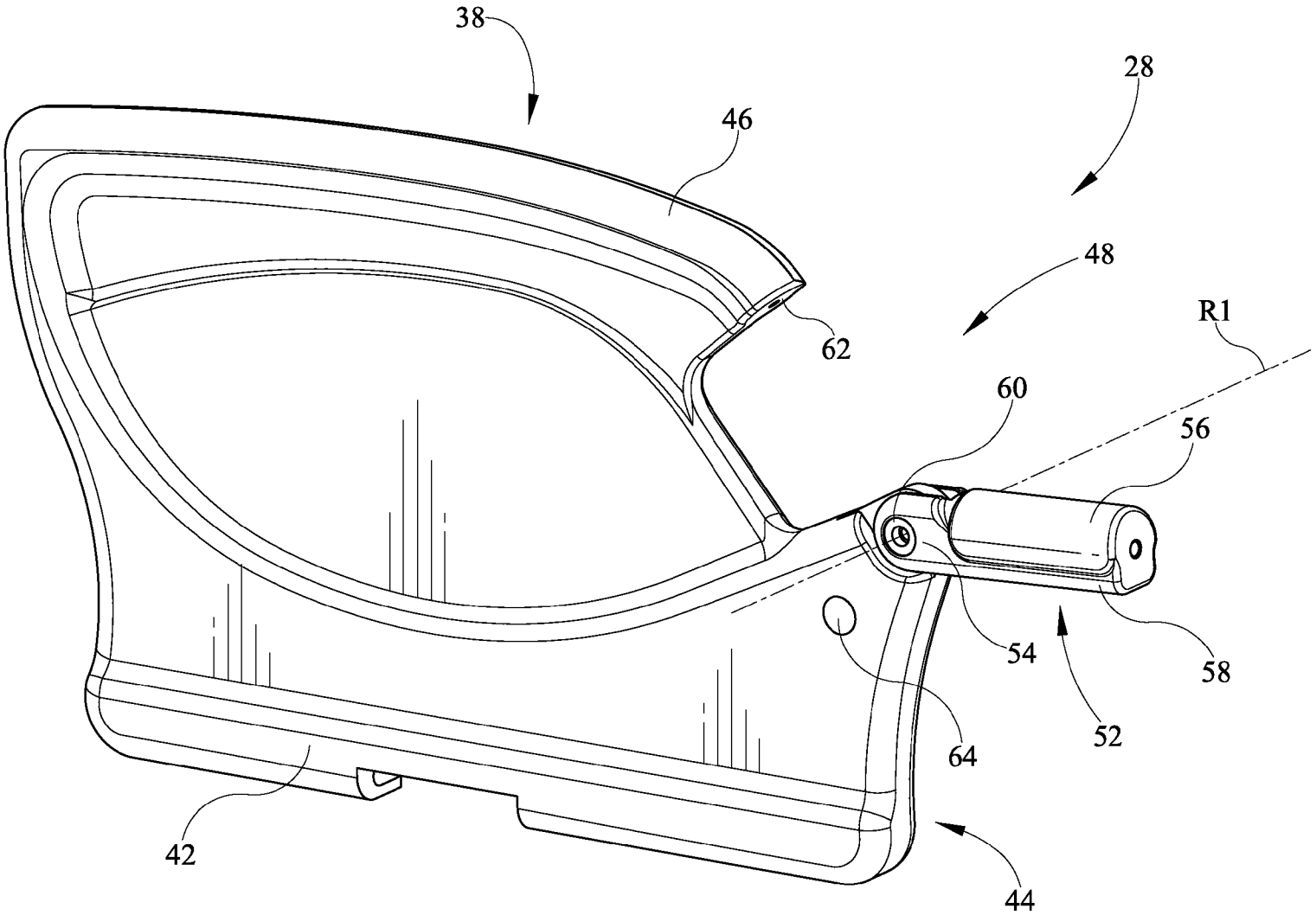
FIG. 4 is a perspective side view of the siderail of FIG. 1 showing the handle in a second position with respect to the siderail body.

The siderail body 38 can include a first surface 42, a second surface 44, a perimeter edge 46 extending between the first surface 42 and the second surface 44, and a grip portion 48 as shown in FIGS. 3 and 4. In one contemplated embodiment, a portion of the siderail body 38 is hollow. The grip portion 48 can include a grip opening 50 and a handle 52. In some contemplated embodiments, the handle 52 can be coupled to an endboard 26. The handle 52 can include a first end 54, a grip 56, and a second end 58. The grip 56 can be positioned between the first end 54 and the second end 58 and can be configure to be gripped by a person. In some contemplated embodiments, the handle 52 can be configured to extend from a first length to a second length when the handle 52 is in the deployed position. In some contemplated embodiments, the handle 52 includes a telescoping portion (not shown) that extends the length of the handle 52. Also, in some embodiments, the telescoping portion can be spring loaded (not shown) or can include a rack and pinion arrangement (not shown) to extend the handle 52 as the handle 52 moves from the storage position to the deployed position. Also, in some contemplated embodiments, the head portion 32 of the deck 22 can be prevented from moving when the handle 52 is telescoped and in the deployed position.

The first end 54 of the handle 52 can be movably coupled to the siderail body 38 at a first joint 60 and the second end 58 can be removably coupled to the siderail body 38 at a second joint 62. The handle 52 can be configured to rotate about a rotational axis R1 passing through the first joint 60 between a storage position and an ingress/egress or deployed position. In one illustrative embodiment, the handle 52 can be substantially horizontally oriented when the deck 22 is at an angle of 50° with respect to the upper frame base 20 and the handle 52 is in the ingress/egress position. In some contemplated embodiments, the first joint 60 can be configured to rotate the handle 52 about the rotational axis R1 from the storage position to the deployed position and then rotate the handle 52 side to side in a plane (not shown) passing through the rotational axis R1 while in the deployed position. The first joint 60 can include a stop ST1 that can define the deployed position. In one illustrative embodiment of the disclosure, the handle 52 can be configured to form a portion of the perimeter edge 46 in the storage position as shown in FIG. 3, and can be substantially parallel to the upper frame 16 in the ingress/egress position as shown in FIG. 4. In some contemplated embodiments, the handle 52 does not form a portion of the perimeter edge 46 of the siderail body 38 and instead is stored within the siderail body 38 and extends out of the siderail body 38 in the deployed position. In some contemplated embodiments, the handle 52 can be extended from within the siderail body mechanically or manually.

The handle 52 can be selectively maintained in the storage position by a locking assembly (not shown). In one illustrative embodiment, the locking assembly can be a ratcheting mechanism that can be configured to maintain the orientation of the handle 52 at any position between the storage position and the ingress/egress position and including the storage position and the ingress/egress position. In another illustrative embodiment, the locking assembly can include a spring loaded sphere (not shown) protruding from the siderail body 38 proximate to the second joint 62 that can engage a recessed portion (not shown) of the second end 58 of the handle 52 and can selectively maintain the handle 52 in the storage position. In another illustrative embodiment, the locking assembly can be actuated by a push button 64 as shown in FIGS. 3 and 4.

Many other embodiments of the present disclosure are also envisioned. For example, a siderail assembly comprises a siderail body, a siderail linkage and a handle. The siderail body has a perimeter edge. The siderail linkage is configured to movably couple the siderail body to a person-support apparatus. The siderail linkage is configured to move the siderail body between a first position and a second position with respect to the person-support apparatus. The handle is movably coupled to the siderail body. The handle is configured to form a portion of the perimeter edge of the siderail body in a first position. The handle is configured to assist with at least one of ingress and egress to/from the person-support apparatus in a second position.

In another example, a siderail assembly comprises a siderail body and a siderail linkage. The siderail body includes a perimeter edge and an opening there through. The opening cooperates with the perimeter edge to define a grip. The grip includes a first portion and a second portion. The first portion is configured to be movably coupled to the siderail body and removably coupled to the second portion. The first portion is configured to move between a first position and a second position with respect to the siderail body and second portion. The siderail linkage is configured to movably couple the siderail body to a structure. The siderail linkage is configured to move the siderail body between a first position and a second position with respect to the structure.

In yet another example, a siderail for a person-support apparatus, the siderail comprises a siderail body, a handle and a locking assembly. The siderail body defines a perimeter edge. The handle is incorporated in the siderail. The handle is movable along a joint between a first position and a second position. In the first position, the handle is configured to form a portion of the perimeter edge. In the second position, the handle is configured to assist with at least one of ingress and egress to/from the person-support apparatus. The locking assembly is configured to lock the handle in the first position and the second position.

In still another example, a siderail for a person-support apparatus having a frame and a head support section coupled to the frame. The head support section moves relative to the frame from a generally horizontal position to an elevated position. The siderail comprises a siderail body, a handle, a locking assembly and a button. The siderail body defines a perimeter edge. The handle is incorporated in the siderail. The handle is movable along a joint between a first position and a second position. In the first position, the handle is configured to form a portion of the perimeter edge. In the second position, the handle is configured to assist with at least one of ingress and egress to/from the person-support apparatus. The locking assembly locks the handle in the first position. The button is configured to release the locking assembly and allows the handle to move along the joint and fixed into the second position.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. A perimeter panel for a person-support apparatus, comprising:

a panel body including a perimeter edge, and a handle rotatably coupled to the panel body and configured to move between a storage position and a deployed position, the handle forms a portion of the perimeter edge of the panel body when the handle is in the storage position and extends from the panel body in the deployed position, wherein the panel body includes a space recessed from the perimeter edge, the space includes N sides when the handle is in the storage position and N−1 sides when the handle is in the deployed position.

2. The perimeter panel of claim 1, wherein the handle includes a first end movably coupled to the panel body and a second end configured to be coupled to the panel body in the storage position and not coupled to the panel body in the deployed position.

3. The perimeter panel of claim 1 further comprising a locking mechanism configured to selectively maintain the handle in at least one of the storage position and the deployed position.

4. The perimeter panel of claim 3, wherein the handle includes a first end movably coupled to the panel body at a first joint and a second end that is selectively coupled to the panel body by the locking mechanism at a second joint.

5. The perimeter panel of claim 1, wherein the perimeter panel includes a siderail.

6. The perimeter panel of claim 1, wherein the panel body includes a stop that cooperates with the handle to define the deployed position.

7. A perimeter panel for a person-support apparatus, the perimeter panel comprising:

a panel body including a first surface, a second surface, a side surface extending between the first surface and the second surface;

a handle being configured to move between a storage position and a deployed position, the handle includes a first end rotatably coupled to the panel body and a second end configured to be coupled to the panel body in the storage position and free in the deployed position.

8. The perimeter panel of claim 7 further comprising a locking assembly configured to selectively maintain the handle in at least one of the deployed position and the storage position.

9. The perimeter panel of claim 8, wherein the locking assembly includes a button configured to be pushed to one of lock and unlock the locking assembly.

10. The perimeter panel of claim 8, wherein the locking assembly is further configured to selectively maintain the handle in an intermediate position between the deployed position and the storage position.

11. The perimeter panel of claim 7, wherein the panel body includes a stop that cooperates with the handle to define the deployed position.

12. The perimeter panel of claim 7, wherein the handle is coupled proximate to a cavity recessed from the side surface of the side surface.

13. The perimeter panel of claim 7, wherein the panel body includes a space recessed from the perimeter edge, the handle extending substantially across the space and cooperating with the panel body to encircle the space when the handle is in the storage position.

14. The perimeter panel of claim 7, wherein the handle is positioned in a space within the panel body in the storage position and extends from the panel body in the deployed position.

15. A person-support apparatus, comprising:

a frame; and a siderail coupled to the frame and including a siderail body and a handle, the handle being configured to move between a storage position and a deployed position, the handle includes a first end rotatably coupled to the siderail body and a second end configured to be coupled to the siderail body in the storage position and free in the deployed position.

16. The person-support apparatus of claim 15, wherein the frame includes a first portion and a second portion, the first portion being movable between a first inclined position and a second inclined position with respect to the second portion, the siderail being coupled to the first portion and the handle being substantially parallel to the second portion when the first portion is in the second inclined position and the handle is in the deployed position.

17. The person-support apparatus of claim 15 further comprising a locking mechanism configured to maintain the handle in at least one of the storage position and the deployed position.

18. The person-support apparatus of claim 15, wherein the siderail body includes a stop that cooperates with the handle to define the deployed position.

19. The person-support apparatus of claim 15, wherein the siderail body includes a space recessed from a perimeter edge of the siderail body, the handle extending substantially across the space and cooperating with the siderail body to encircle the space when the handle is in the storage position.

20. The perimeter panel of claim 15, wherein the handle is positioned in a space within the siderail body in the storage position and extends from the siderail body in the deployed position.

* * * * *